US007681626B2

(12) United States Patent
Hagiwara et al.

(10) Patent No.: US 7,681,626 B2
(45) Date of Patent: Mar. 23, 2010

(54) CONTINUOUS CASTING METHOD, CAST MEMBER, METAL WORKED ARTICLE, AND CONTINUOUS CASTING APPARATUS

(75) Inventors: Yasuhisa Hagiwara, Oyama (JP); Shigeru Yanagimoto, Kitakata (JP)

(73) Assignee: Showa Denko K.K., Tokyo (JP)

( * ) Notice: Subject to any disclaimer, the term of this patent is extended or adjusted under 35 U.S.C. 154(b) by 0 days.

(21) Appl. No.: 10/565,540

(22) PCT Filed: Jul. 23, 2004

(86) PCT No.: PCT/JP2004/010977

§ 371 (c)(1),
(2), (4) Date: Oct. 18, 2006

(87) PCT Pub. No.: WO2005/007321

PCT Pub. Date: Jan. 27, 2005

(65) Prior Publication Data

US 2007/0077446 A1 Apr. 5, 2007

Related U.S. Application Data

(60) Provisional application No. 60/490,512, filed on Jul. 29, 2003.

(30) Foreign Application Priority Data

Jul. 23, 2003 (JP) ..... 2003-278297

(51) Int. Cl.
*B22D 11/06* (2006.01)

(52) U.S. Cl. ..... 164/482; 164/433

(58) Field of Classification Search ..... 164/480, 164/442, 448, 428, 482, 433
See application file for complete search history.

(56) References Cited

U.S. PATENT DOCUMENTS

| | | | | |
|---|---|---|---|---|
| 3,575,231 | A | 4/1971 | Lenaeus | |
| 3,587,717 | A | 6/1971 | Yamauchi et al. | |
| 3,759,314 | A | 9/1973 | Murphy | |
| 4,524,821 | A * | 6/1985 | Berry et al. | 164/482 |

FOREIGN PATENT DOCUMENTS

| | | |
|---|---|---|
| JP | 53-123332 | 10/1978 |
| JP | 59-193737 | 11/1984 |
| JP | 62 292244 | 12/1987 |
| JP | 62-292244 A * | 12/1987 |
| JP | 4-138846 | 5/1992 |
| JP | 5 311271 | 11/1993 |

OTHER PUBLICATIONS

U.S. Appl. No. 11/212,729, filed Aug. 29, 2005, Hagiwara et al.

*Primary Examiner*—Kevin P Kerns
(74) *Attorney, Agent, or Firm*—Oblon, Spivak, McClelland, Maier & Neustadt, L.L.P.

(57) ABSTRACT

A continuous casting member causes a final solidification portion to be displaced from a central portion of a cast member to reduce influence of cast defects that may be generated on a plastic worked article. In a continuous casting method for continuously manufacturing a cast member by driving a plurality of rotational molding members disposed to form a casting space, the plurality of rotational molding members are differentiated in temperature. A portion of one of the rotational molding members that starts to come into contact with molten metal can be set to a temperature of [(melting point or liquidus temperature of the metal)×0.35] or more, and the other of the rotational molding members can be cooled.

18 Claims, 4 Drawing Sheets

FOREIGN PATENT DOCUMENTS

| | | | |
|---|---|---|---|
| JP | 5-311271 A | * | 11/1993 |
| JP | 9-85393 | | 3/1997 |
| JP | 10-317084 | | 12/1998 |
| JP | 10-317084 A | * | 12/1998 |

* cited by examiner

CONTINUOUS CASTING METHOD, CAST MEMBER, METAL WORKED ARTICLE, AND CONTINUOUS CASTING APPARATUS

Priority is claimed to Japanese Patent Application No. 2003-278297 filed on Jul. 23, 2003, and U.S. Provisional Application No. 60/490,512 filed on Jul. 29, 2003, the disclosure of which are incorporated by reference in their entireties.

CROSS REFERENCE TO RELATED APPLICATIONS

This application is an application filed under 35 U.S.C. § 111(a) claiming the benefit pursuant to 35 U.S.C. § 119(e)(1) of the filing date of Provisional Application No. 60/490,512 filed on Jul. 29, 2003 pursuant to 35 U.S.C. § 111(b).

TECHNICAL FIELD

The present invention relates to a continuous casting method. It also relates to a cast member manufactured by the continuous casting method, a metal worked article manufactured from the cast member and a continuous casting apparatus for performing the continuous casting method.

BACKGROUND ART

As a metal continuous casting method, a properzi method is known. In this method, a casting space is formed between a groove formed on a peripheral surface of a casting wheel and an endless belt fitted on the groove. Molten metal is supplied to the casting space when the casting wheel and the endless belt are rotating to continuously manufacture a cast member. In such a continuous casting method, the casting wheel and the endless belt are cooled, and therefore the molten metal supplied to the casting space will be gradually solidified from the entire circumference thereof toward the central portion thereof (see, e.g., Japanese Unexamined Laid-open Patent Publication No. S53-123332 and Japanese Unexamined Laid-open Patent Publication No. S59-193737).

In the aforementioned continuous casting method, the final solidification portion will be positioned at the central portion of the cast member, and therefore shrinkage cavities and/or breakages tend to be generated at the central portion due to the solidification shrinkage. Accordingly, in the cast member having such defects, even if the cast member is subjected to plastic working such as rolling, extruding or drawing, the end product will contain the cast defects.

The aforementioned Japanese Unexamined Laid-open Patent Publication No. S53-123332 discloses that the casting wheel and the endless belt are held at 40 to 200 ° C. to avoid quick cooling of the cast member to thereby prevent the cast cracking. In this method, however, although cracking of the contact portion of the cast member contacting the casting wheel and/or the endless belt can be prevented, the shrinkage cavities and/or breakages in the final solidification portion cannot be prevented. Furthermore, although cast defects generated at the surface of the cast member can be disappeared or reduced by the following plastic working, cast defects generated at the central portion will not be dissolved. Furthermore, if cast defects exist at the central portion of the cast member or worked article, they cannot be removed by scalping or peeling processing.

The description herein of advantages and disadvantages of various features, embodiments, methods, and apparatus disclosed in other publications is in no way intended to limit the present invention. Indeed, certain features of the invention may be capable of overcoming certain disadvantages, while still retaining some or all of the features, embodiments, methods, and apparatus disclosed therein.

DISCLOSURE OF INVENTION

The preferred embodiments of the present invention have been developed in view of the above-mentioned and/or other problems in the related art. The preferred embodiments of the present invention can significantly improve upon existing methods and/or apparatuses.

Among other potential advantages, some embodiments can provide a continuous casting method capable of reducing an influence of cast defects which may be generated in a cast member on a worked article by shifting the final solidification portion from the central portion of the cast member.

Among other potential advantages, some embodiments can provide a cast member manufactured by the aforementioned continuous casting method.

Among other potential advantages, some embodiments can provide a metal worked article made of the aforementioned cast member.

Among other potential advantages, some embodiments can provide a continuous casting apparatus for performing the aforementioned continuous casting method.

The continuous casting method according to the present invention has a structure as recited in the following Items (1) to (7).

(1) A continuous casting method for continuously manufacturing a cast member by driving a plurality of rotational molding members disposed so as to form a casting space in a state in which the plurality of rotational molding members are differentiated in temperature.

(2) The continuous casting method as recited in the aforementioned Item (1), wherein a portion of one of the rotational molding members which starts to come into contact with molten metal is set to a temperature of [(melting point or liquidus temperature of the metal)×0.35] or more, and wherein the other rotational molding members are cooled.

(3) The continuous casting method as recited in the aforementioned Item (2), wherein the portion of one of the plurality of rotational molding members which starts to come into contact with the molten metal is set to a temperature of [(melting point or liquidus temperature of the metal)×0.5] or more.

(4) The continuous casting method as recited in the aforementioned Item (2) or (3), wherein the temperature of the portion of one of the plurality of rotational molding members is set by heating the portion before the portion starts to come into contact with the molten metal.

(5) The continuous casting method as recited in any one of the aforementioned Items (1) to (4), wherein the plurality of rotational molding members are a pair of rolls disposed at a certain distance.

(6) The continuous casting method as recited in any one of the aforementioned Items (1) to (4), wherein the plurality of rotational molding members are a casting wheel with a groove formed on an external peripheral surface thereof and an endless belt put on the casting wheel so as to close the groove.

(7) The continuous casting method as recited in any one of the aforementioned Item (1) to (6), wherein the metal is aluminum or its alloy.

(8) The continuous casting method as recited in any one of the aforementioned Items (1) to (6), wherein the metal is copper or its alloy.

A cast member according to the present invention has a structure as recited in the following Item (9) or (10).

(9). A cast member continuously cast by the method as recited in any one of the aforementioned Items (1) to (8), wherein a final solidification portion is located within a depth from a surface of the cast member, the depth being [(thickness of the cast member)×0.2] or less.

(10) The cast member as recited in the aforementioned Item (9), wherein a surface layer portion is removed from the cast member.

A metal worked article according to the present invention has a structure as recited in the following Item (11).

(11) A metal worked article obtained by performing plastic working to the cast member as recited in the aforementioned Item (9) or (10).

A continuous casting apparatus according to the present invention has a structure as recited in the following Item (12) or (13).

(12) A continuous casting apparatus, comprising:

a plurality of rotational molding members disposed so as to form a casting space, the rotational molding members being driven in a direction of casting;

a heating device which is configured to heat some of the rotational molding members; and a cooling device which is configured to cool the other of the rotational molding members.

(13) The continuous casting apparatus as recited in claim 12, wherein the heating device is disposed ahead of a position where the some of the rotational molding members start to come into contact with molten metal.

According to the continuous casting method of the present invention, since the plurality of rotational molding members are differentiated in temperature, a cast member in which the final solidification portion is displaced toward the side of the rotational molding member with higher temperature can be manufactured. In such as cast member, even if cast defects are generated in the final solidification portion, the cast defects can be removed by removing the surface layer portion. Cast defects existing at a portion near the surface will be disappeared or reduced by plastic working, whereby no cast defect will be included in a worked article.

In the continuous casting method, in cases where a portion of one of the rotational molding members which starts to come into contact with molten metal is set to a temperature of [(melting point or liquidus temperature of the metal)×0.35] or more and the other of the rotational molding members are cooled, the displacement of the final solidification portion can be made assuredly.

Furthermore, in cases where the portion of one of the plurality of rotational molding members which starts to come into contact with the molten metal is set to a temperature of [(melting point or liquidus temperature of the metal)×0.5] or more, the displacement of the final solidification portion becomes large, which causes the final solidification to be formed at a portion near the surface of the cast member.

Furthermore, in cases where the temperature of the portion of one of the plurality of rotational molding members is set by heating the portion before the portion starts to come into contact with the molten metal, the temperature of the portion can be set to a prescribed temperature.

In cases where the plurality of rotational molding members are a pair of rolls disposed at a certain distance, a cast member in which the final solidification portion is displaced can be manufactured more smoothly.

In cases where the plurality of rotational molding members are a casting wheel with a groove formed on an external peripheral surface thereof and an endless belt put on the casting wheel so as to close the groove, a cast member in which the final solidification portion is displaced can also be manufactured more smoothly.

In cases where the metal is aluminum or its alloy, an aluminum or aluminum alloy cast member in which the final solidification portion is displaced can also be manufactured more smoothly.

In cases where the metal is copper or its alloy, a copper or copper alloy cast member in which the final solidification portion is displaced can also be manufactured more smoothly.

The cast member according to the present invention is a cast member continuously cast by the aforementioned method, and the final solidification portion is located within a depth from a surface of the cast member, the depth being [(thickness of the cast member)×0.2] or less. In such as cast member, even if cast defects are generated in the final solidification portion, the cast defects can be removed by removing the surface layer portion. Cast defects existing at a portion near the surface will be disappeared or reduced by plastic working, whereby no cast defect will be included in a worked article.

In cases where a surface layer portion is removed from the cast member, the cast defects have been removed or can be disappeared or reduced by plastic working.

Since the metal worked article is an article obtained by performing plastic working to the cast member, it is free from cast defects and high in quality.

The continuous casting apparatus according to the present invention includes a plurality of rotational molding members disposed so as to form a casting space, the rotational molding members being driven in a direction of casting, a heating device which is configured to heat some of the rotational molding members, and a cooling device which is configured to cool the other of the rotational molding members. Therefore, by performing the continuous casting method of the present invention, a cast member in which the final solidification portion is displaced can be manufactured.

In cases where the heating device is disposed ahead of a position where the some of the rotational molding members start to come into contact with molten metal, the temperature of the some of the rotational molding members can be set to a prescribed temperature.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims.

BRIEF DESCRIPTION OF DRAWINGS

The preferred embodiments of the present invention are shown by way of example, and not limitation, in the accompanying figures, in which.

BEST MODE FOR CARRYING OUT THE INVENTION

In the following paragraphs, some preferred embodiments of the invention will be described by way of example and not limitation. It should be understood based on this disclosure that various other modifications can be made by those in the art based on these illustrated embodiments.

In a continuous casting method according to an embodiment of the present invention, a plurality of rotational molding members disposed so as to form a casting space are differentiated in temperature to thereby differentiate the solidification rates in the cast member, so that the final solidification portion is shifted from the central portion of the cast member toward the slow solidification rate side, i.e., toward the side of the rotational molding portion with higher temperature.

Hereinafter, the present invention will be detailed with reference to a concrete continuous casting method and a continuous casting apparatus for performing the method.

First Embodiment

Figure 1:
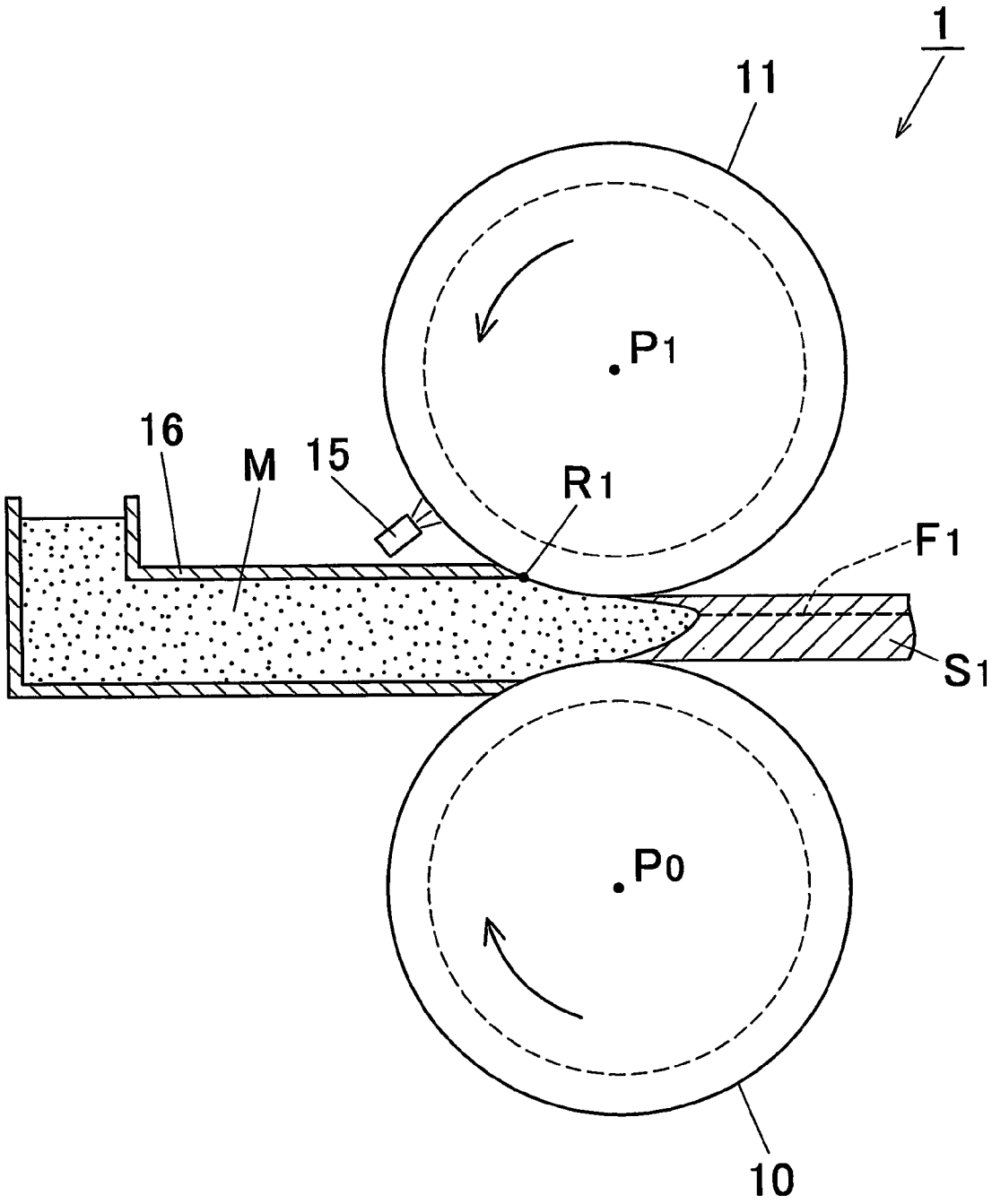
FIG. 1 is a schematic view showing a structure of a continuous casting apparatus for performing a first embodiment of a continuous casting method according to the present invention.
Figure 2:
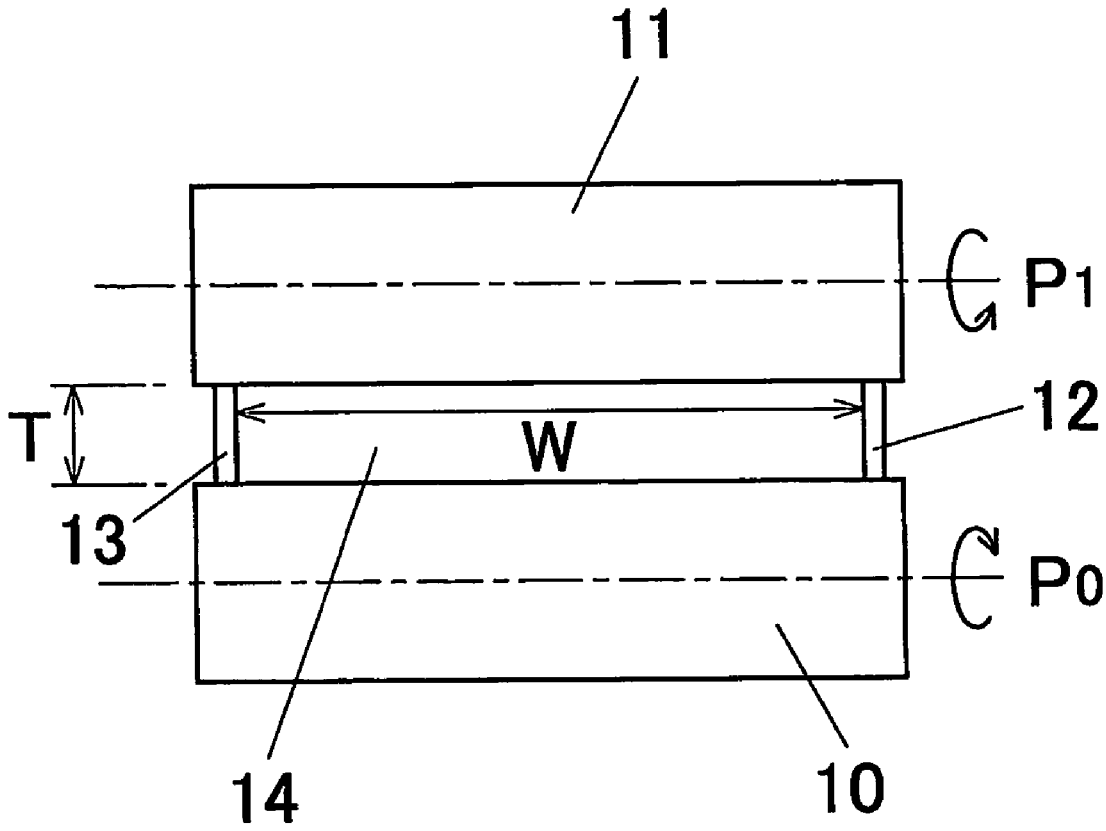
FIG. 2 is a schematic view showing a pair of rolls and a casting space in the continuous casting apparatus shown in FIG. 1.

FIGS. 1 and 2 show a continuous casting apparatus 1 for performing a continuous casting method according to the present invention.

In this continuous casting apparatus 1, a pair of rolls 10 and 11 are disposed in parallel with each other at a roll surface distance T, and holding plates 12 and 13 for holding molten metal M are disposed between these rolls 10 and 11 at a distance W. Thus, the rolls 10 and 11 and the holding plates 12 and 13 form a casting space 14. Accordingly, in this continuous casting apparatus 1, a rectangular cast member S1 having a cross-section of T×W can be continuously manufactured. The pair of rolls 10 and 11 are configured such that the respective inner peripheries can be cooled by cooling water supplied via nozzles (not shown), and one of the rolls is configured such that the external periphery thereof can be heated with a burner 15 provided outside the roll 11 and positioned immediately before the roll 11 comes into contact with the molten metal M at the molten metal M supplying side.

In this continuous casting apparatus 1, the molten metal M supplied from the tundish 16 to the casting space 14 is continuously formed into a cast member S1 and transferred while being solidified from the roll contact surface to the inside by being cooled by the rolls 10 and 11. At this time, when one of the rolls 10 is cooled by cooling water and the other roll 11 is heated with the burner 15 without supplying cooling water, the molten metal at the side of the heated roll 11 will be hardly cooled, while the solidification at the side of the cooled roll 10 will be enhanced. Accordingly, the final solidified portion F1 will be located at the side of the heated roll 11.

Second Embodiment

Figure 3:
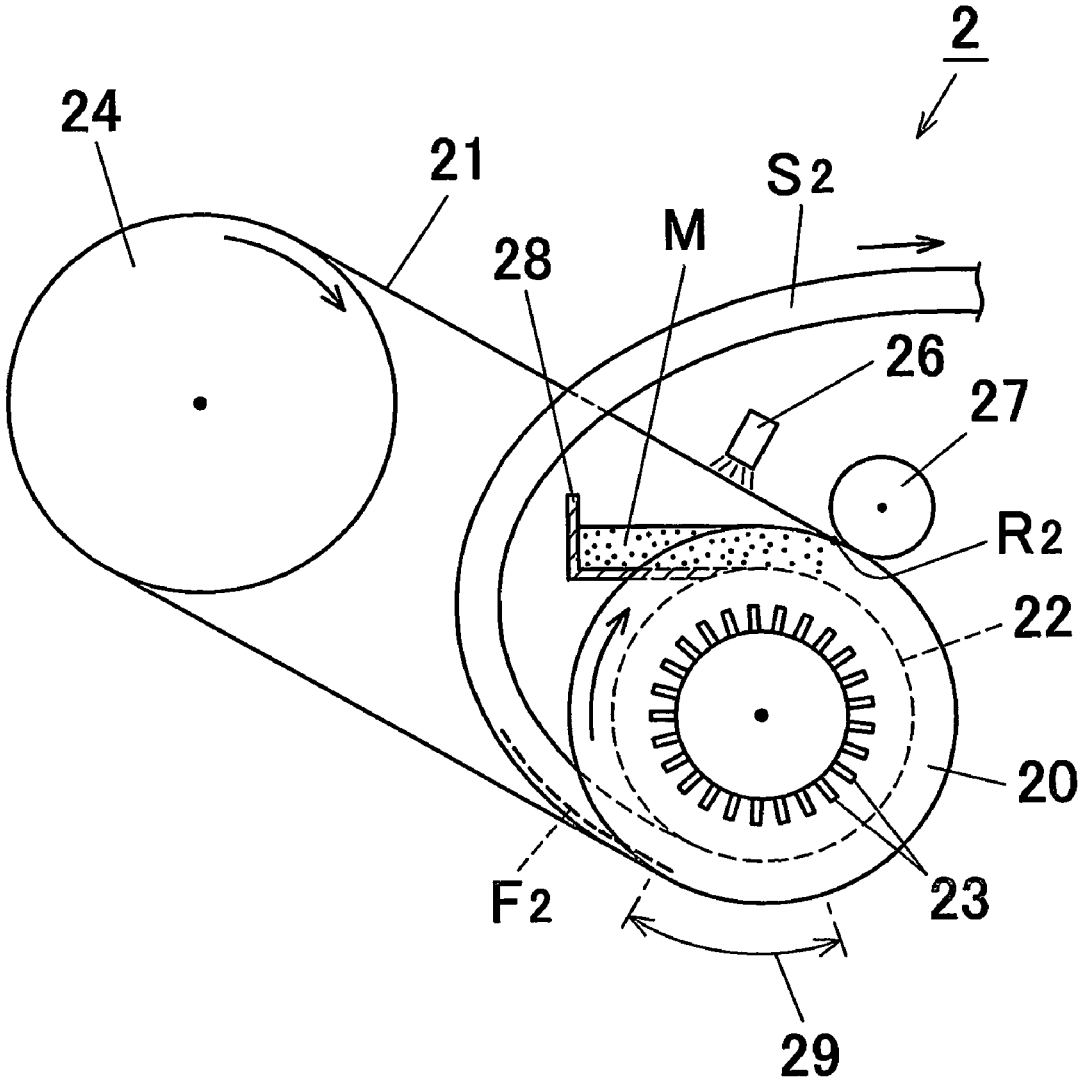
FIG. 3 is a schematic view showing a structure of a continuous casting apparatus for performing a second embodiment of a continuous casting method according to the present invention.
Figure 4:
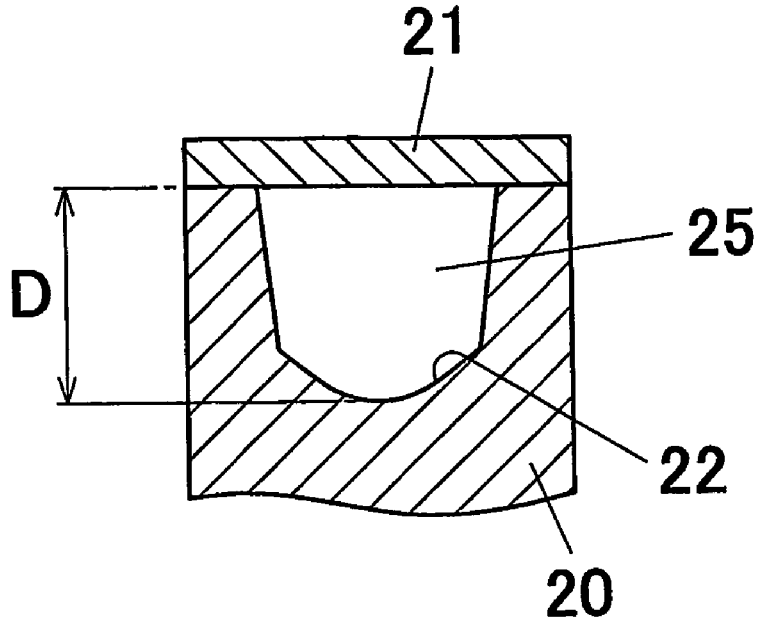
FIG. 4 is an enlarged view showing a principal portion of FIG. 3.

FIGS. 3 and 4 schematically show a continuous casting apparatus 2 for performing a continuous casting method of the present invention.

The continuous casting apparatus 2 is provided with a casting wheel 20 and an endless belt 21.

The casting wheel 20 is provided with a groove 22 formed on the external surface and can be cooled by cooling water supplied from nozzles 23 provided within the wheel 20. On the other hand, the endless belt 21 is put on the casting wheel 20 and a tension adjusting wheel 24 so as to close the groove 22 of the casting wheel 20, thereby forming a casting space 25. Furthermore, the belt 21 is capable of being heated with a burner 26 immediately before the belt comes onto contact with the casting wheel 20.

In FIG. 3, the reference numeral 27 denotes a pinch roll for pressing the belt 21 on the casting wheel 20. The reference numeral 28 denotes a tundish for supplying molten metal M to the casting space 25.

Figure 5:
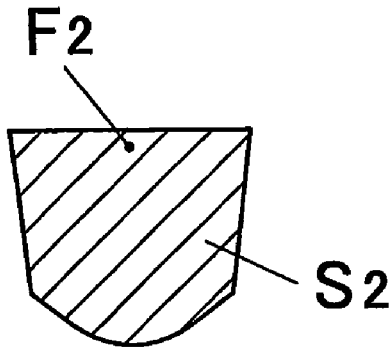
FIG. 5 is a cross-sectional view showing a cast member manufactured by the continuous casting apparatus shown in FIG. 3.

In this continuous casting apparatus 2, the molten metal M supplied from the tundish 28 to the casting space 25 is continuously formed into a cast member S2 in accordance with the rotation of the casting wheel 20 and the belt 21 while being solidified from the contact surface to the inside by being cooled by the casting wheel 20 and the belt 21. In this solidifying process, the molten metal M will be hardly cooled at the side of the belt 21, and the solidification will be enhanced at the side of the casting wheel 20. Accordingly, the final solidification portion F2 will be located at the side of the belt 21 (FIG. 5).

As shown in FIG. 3, at the final casting area 29 where the solidification of the cast member is almost completed, the belt 21 can be cooled for the purpose of preventing the breakage of the belt 21.

In the aforementioned embodiments, in order to differentiate the plurality of rotational molding members 10, 11 (20 and 21) in temperature, the rotational molding member 11 (21) to be set at higher temperature is heated, while another rotational molding member 10 (20) to be set at lower temperature is cooled in the same manner as a conventional continuous casting method, to thereby attain the solidification of the molten metal by cooling from one direction. The temperature of the rotational molding member 11(21) at the higher temperature side is set depending on the casting metal, preferably set to a temperature of [(melting point or liquidus temperature of the metal)×0.35] or more. If the temperature is less than a temperature of [(melting point or liquidus temperature of the metal)×0.35], the displacement magnitude of the final solidification portion becomes insufficient, causing an increased amount to be removed, which deteriorates material yields. The preferable temperature is a temperature of [(melting point or liquidus temperature of the metal)×0.5] or more, and more preferably, [(melting point or liquidus temperature of the metal)] ×0.6 or more. In the case of aluminum or its alloy, it is preferable that the temperature is 230° C. or more, preferably 330 ° C. or more, more preferably 400° C. or more. In the case of copper or its alloy, it is preferable that the temperature is 380° C. or more, preferably 540 ° C. or more, more preferably 650° C. or more.

The aforementioned temperature, i.e., the temperature of the rotational molding member 11(21) at the higher temperature side, is defined as a temperature at the portion R1(R2) where the rotational member 11(21) starts to come into contact with the molten metal M. Although the driving rotational molding member 11(21) is slightly different in temperature between when the member 11(21) starts to come into contact with the molten metal M and when the casting is completed, solidification control with higher precision can be performed by performing thermal management at the portion R1(R2) where the molding member 11(21) starts to come into contact with the molten metal M in which the solidification rate is directly influenced.

A means for setting the rotational molding member 11(21) to a prescribed temperature is not limited to the aforementioned burner 15(26), and any known heating means or a combination thereof can be used. Furthermore, a means for cooling the other rotational molding member 10(20) is not limited to water, and any known cooling means or a combination thereof can be used.

The rotational molding members are not limited to the aforementioned pair of rolls 10 and 11 or the aforementioned combination of the casting wheel 20 and the endless belt 21. The aforementioned molding members are rotational molding members which have been conventionally used for continuous casting. The continuous casting method according to the present invention can be carried out by simply adding a heating means to the conventional rotational molding members to manufacture a cast member in which the final solidification portion is displaced. In the present invention, at least two rotational molding members are required, and the number of rotational molding members can be 3(three) or more. In cases where 3(three) or more rotational molding members are used, the number of members to be heated and the number of members to be cooled can be arbitrarily set.

The present invention can be applied to various metal continuous casting, especially to aluminum or its alloy continuous casting or copper or its alloy continuous casting.

A cast member according to the present invention is manufactured by the aforementioned continuous casting method. In the cast member, the final solidification portion F1 (F2) is displaced from the central portion of the cast member to within a depth from the surface of the cast member S1(S2) due to the temperature differences between the rotational molding members, wherein the depth is obtained by multiplying the thickness of the cast member S1(S2) by 0.2. In the final solidification portion F1(F2), cast defects such as shrinkage cavities and/or shrinkage cracks may sometimes be generated. However, in cases where such cast defects are generated at a portion near the surface of the cast member, the surface layer portion including the defects can be easily removed by cutting or the like. Furthermore, in cases where such cast defects are located near the surface, there is a possibility that such cast defects are disappeared or decreased. In the case of removing the surface layer portion, an amount to be removed (a depth to be removed) is not limited. It is not always necessary to completely remove the final solidification portion. In cases where plastic processing is followed, the removal can be performed up to the vicinity of the final solidification portion in consideration of disappearance or reduction of cast defects due to the following plastic working. Of course, the present invention allows complete removal of the final solidification portion. As shown in FIG. 5, in the cast member S2 manufactured by using the endless belt 21, the final solidification portion F2 tends to be located at the central portion of the cast member S2 in the width direction or thereabout. In such a case, there is no need to remove the entire region of the surface layer portion along the width direction at an even depth to obtain a flat surface. Instead, the vicinity of the final solidification portion F2 can be removed in the shape of "V" or "U."

A metal worked article according to the present invention is an article manufactured by subjecting the cast member to plastic working, and is free from cast defects and high in quality. The plastic working method is not limited to a specific one, and any known plastic working such as rolling, extruding, drawing, forging, bending or pressing can be employed. The shape of the worked article is not limited.

A continuous casting apparatus according to the present invention is required to equip the aforementioned plurality of rotational molding members, heating means and cooling means. However, structures of another means such as a means for supplying molten metal or a means for transferring the cast metal are not limited, and any know means and structure can be arbitrarily employed.

EXAMPLE 1

In Example 1, a continuous casting test was carried out with respect to Al—Mn series alloy, JIS A3003 (liquidus temperature: 654° C.), by using the continuous casting apparatus 1 shown in FIGS. 1 and 2. The pair of rolls 10 and 11 each having a diameter of 300 mm were disposed at a surface distance T of 6 mm. The distance W between the holding plates 12 and 13 was set to 100 mm. Thus, a cast member S1 with a thickness of 6 mm and a width of 100 mm was continuously cast.

One of the rolls 10 was cooled, while the other was heated with the burner 15 so that the portion R1 of the roll 10 that starts to come into contact with the molten metal M was set to 500° C. After the casting, the cross-section of the cast member S1 was observed. The observation revealed that the final solidification portion F1 was located at 1 mm depth from the surface at the side of the heated roll 10 and cast defects were generated. However, since the cast defects were located at 1 mm depth with respect to the 6 mm thick cast member S1, the cast defects could be easily removed.

The manufactured cast member S1 can be rolled into a rolled material with a prescribed thickness, and further can be subjected to press working.

As a comparative example, a cast member was continuously cast in the same manner as in Example 1, except that both the rolls 10 and 11 were cooled by water. In the obtained cast member, the final solidification portion F1 was located at the central portion in the thickness direction, and shrinkage cavities were generated. Since the position of the shrinkage cavities was located at the central portion in the thickness direction, it was essentially impossible to remove them.

EXAMPLE 2

In Example 2-1 and 2-2, continuous casting tests were carried out with respect to Al—Si—Mg series alloy, JIS A6061 (liquidus temperature: 652° C.), by using the continuous casting apparatus 2 shown in FIGS. 4 and 5.

In the continuous casting apparatus 2, the casting wheel 20 having a diameter of 1400 mm, a depth D of a groove 22 of 55 mm, an inner cross-sectional area of the groove 22 (i.e., cross-sectional area of the casting space 25) of 2300 $mm^2$ was used.

In Examples 2-1 and 2-2, the casting wheel 20 was cooled, while the belt 21 was heated with the burner 26 so as to set the temperature of the portion R2 of the belt 21 which starts to come into contact with the molten metal M to the temperature shown in Table 1. As a Comparative Example, nozzles (not shown) for supplying cooling water to the outside of the belt 21 on the casting wheel 20 were added, so that the casting wheel 20 and the belt 21 were cooled by water.

In each Example, the wheel rotating speed was set to 1.8 rpm during the casting process to continuously cast the cast member S2. After the casting, the cross-section of each cast member S2 was observed. The observation revealed that the final solidification portion F2 was located at the depth shown in Table 1 from the surface and cast defects were generated at the final solidification portion F2 and the vicinity thereof.

Next, each cast member S2 was roughly rolled into a round bar having a diameter of 23 mm. By this plastic working, the final solidification portion F2 was located at the position shown in Table 1 from the surface of the round bar.

TABLE 1

| | Belt temperature | Position of the final solidification portion of the cast member Depth from the surface | Position of the final solidification portion of the round bar Depth from the surface |
|---|---|---|---|
| Example 2-1 | 300° C. | 7 mm | 3 mm |
| Example 2-2 | 500° C. | 5 mm | 2 mm |
| Comparative Example | Cooling | 15 mm | Almost center |

As shown in Table 1, in the case of the round bar obtained by rolling the cast member S2 manufactured while heating the belt 21, since the final solidification portion was located near the surface, the cast defects could be removed by cutting the surface portion of the round bar to the depth of 4 mm or 3 mm. On the other hand, in the Comparative Example in which cast defects were located at the center of the round bar, the defects were unable to be removed.

Crystallized substances was large such as about 5 μm at the final solidification portion and therearound of the aforementioned roughly worked round bar, but small such as 3 μm or less at portions other than the above.

The roughly worked round bar can be further subjected to rolling, continuous extruding such as a comform extruding, drawing or forging to obtain a desired article.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." In this disclosure and during the prosecution of this application, means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure and during the prosecution of this case, the following abbreviated terminology may be employed: "e.g." which means "for example;" and "NB" which means "note well."

INDUSTRIAL APPLICABILITY

The present invention relates to a continuous casting method using rotational molding members, and can be utilized for manufacturing metal cast members to be subjected to plastic working such as rolling, extruding, drawing or forging.

The invention claim is:

1. A continuous casting method for continuously manufacturing an aluminum or aluminum alloy metal cast member, comprising:

driving a casting wheel, with a groove formed on an external peripheral surface thereof and an endless belt put on the casting wheel so as to close the groove, in a direction of casting; and causing the casting wheel and the endless belt to be differentiated in temperature therebetween at a portion of the endless belt where molten metal starts to come into contact with the endless belt, said causing including:

heating the endless belt at a position before where the molten metal starts to come in contact with the endless belt such that said portion of the endless belt where molten metal starts to come into contact with the endless belt is heated to a temperature of ((melting point or liquidus-line temperature of the aluminum or aluminum alloy metal) ×0.35) or above, wherein said heating is performed by a heating device that is not configured to heat the molten metal; and cooling the casting wheel.

2. The continuous casting method as recited in claim 1, wherein a temperature of the endless belt at said portion of the endless belt where molten metal starts to come in contact with the endless belt is set to a temperature of ((melting point or liquidus temperature of the metal) ×0.5) or above.

3. The continuous casting method of claim 2, wherein said heating the endless belt comprises heating the endless belt such that said portion is heated to a temperature of ((melting point or liquidus-line temperature of the aluminum or aluminum alloy metal) ×0.6) or above.

4. The continuous casting method as recited in claim 1, wherein said heating the endless belt comprises using a burner to direct heat on to a surface of the endless belt not facing the molten metal.

5. The continuous casting method according to claim 4, wherein said using a burner comprises providing said burner immediately before a position where the endless belt comes in contact with the casting wheel.

6. The continuous casting method of claim 1, wherein said heating comprises heating the endless belt such that the aluminum or aluminum alloy cast member comprises a final solidification portion having relatively larger crystallized substances and located within a depth from a surface of the cast member, the depth being ((thickness of the cast member) ×0.2) or less.

7. The continuous casting method of claim 1, wherein said heating the endless belt comprises heating the endless belt to a temperature of 230° C. or more.

8. The continuous casting method of claim 1, wherein said heating the endless belt comprises heating the endless belt to a temperature of 330° C. or more.

9. The continuous casting method of claim 1, wherein said heating the endless belt comprises heating the endless belt to a temperature of 400° C. or more.

10. A continuous casting apparatus comprising:

a casting wheel with a groove formed on an external peripheral surface thereof, and an endless belt put on the casting wheel so as to close the groove, the casting wheel and the endless belt being configured to be driven in a direction of casting;

a heating device disposed ahead of a position where the endless belt starts to come into contact with aluminum or aluminum alloy molten metal, the heating device being configured to heat a portion of the endless belt, where the molten alloy starts to come into contact with the endless belt, to a temperature of ((melting point or liquidus-line temperature of the aluminum or aluminum alloy metal) ×0.35) or above, wherein the heating device is not configured to heat the molten metal; and a cooling device which is configured to cool the casting wheel.

11. The continuous casting apparatus of claim 10, wherein the heating device comprises a burner configured to direct heat on to a surface of the endless belt not facing the molten metal.

12. A continuous casting apparatus of claim 11, wherein the burner is provided immediately before a position where the endless belt comes in contact with the casting wheel.

13. The continuous casting apparatus of claim 10, wherein the heating device is configured to heat the endless belt such that the aluminum or aluminum alloy cast member comprises a final solidification portion having relatively larger crystallized substances and located within a depth from a surface of the cast member, the depth being ((thickness of the cast member) ×0.2) or less.

14. The continuous casting apparatus of claim 10, wherein the heating device is configured to heat said portion of the endless belt to a temperature of ((melting point or liquidus-line temperature of the aluminum or aluminum alloy metal) ×0.5) or above.

15. The continuous casting apparatus of claim 14, wherein the heating device if configured to heat said portion of the endless belt to a temperature of ((melting point or liquidus-line temperature of the aluminum or aluminum alloy metal) ×0.6) or above.

16. The continuous casting apparatus of claim 10, wherein said heating device is configured to heat the endless belt such that said portion is heated to 230° C. or more.

17. The continuous casting apparatus of claim 10, wherein said heating device is configured to heat the endless belt such that said portion is heated to 330° C. or more.

18. The continuous casting apparatus of claim 10, wherein said heating device is configured to heat the endless belt such that said portion is heated to 400° C. or more.

* * * * *